US005752709A

United States Patent [19]

Melcher

[11] Patent Number: 5,752,709

[45] **Date of Patent: *May 19, 1998**

[54] TRIPLE SKI SYSTEM AND LINKAGE THEREFOR

[76] Inventor: Daniel J. Melcher, 5634 E. Dixileta, Cave Creek, Ariz. 85331

[ * ] Notice: The term of this patent shall not extend beyond the expiration date of Pat. No. 5,458,370.

[21] Appl. No.: 477,757

[22] Filed: Jun. 7, 1995

[51] Int. Cl.[6] ..... A63C 5/00

[52] U.S. Cl. ..... 280/28.15; 280/15; 280/14.2; 280/817

[58] Field of Search ..... 280/12.11, 12.12, 280/15, 16, 17, 14.1, 14.2, 22.1, 28.14, 28.15, 607, 608, 609, 617, 815, 816, 817, 818, 845

[56] References Cited

U.S. PATENT DOCUMENTS

| | | | |
|---|---|---|---|
| 32,360 | 5/1861 | Goodyear et al. | 280/11.14 |
| 3,862,764 | 1/1975 | Hartz | 280/818 |
| 5,458,370 | 10/1995 | Melcher | 280/817 |
| 5,558,354 | 9/1996 | Lion | 280/607 |

FOREIGN PATENT DOCUMENTS

| | | | |
|---|---|---|---|
| 4100327 | 7/1991 | Germany | 280/607 |

*Primary Examiner*—Richard M. Camby
*Assistant Examiner*—Frank Vanaman
*Attorney, Agent, or Firm*—John D. Titus

[57] ABSTRACT

Ski apparatus with two outer skis and a third ski, located between the two outer skis, coupled to the outer skis by four cranks, connected as a front pair and a rear pair. Each crank has a gear on one end and a free end. The free end of a crank is attached to a journal box on an outer ski to permit the crank to rotate freely. The gear of the crank from one outer ski meshes with the gear of a crank attached to the other outer ski, coupling the cranks in pairs and causing the cranks to rotate in opposite directions. The gears from each pair are contained in a gearbox attached to the third or middle ski. In one embodiment, the journal box may be slidably attached to the ski, to permit the ski to move forward and backward relative to the journal box, thereby permitting the user to alternately advance and retreat the skis relative to each other. In another embodiment, ski bindings are attached to the center ski by means of a linkage to allow vertical movement of the ski bindings relative to the center ski, thereby allowing the ski apparatus to be canted without the ski bindings interfering with the outer skis.

16 Claims, 4 Drawing Sheets

TRIPLE SKI SYSTEM AND LINKAGE THEREFOR

BACKGROUND OF THE INVENTION

This invention relates to a ski system incorporating a linkage to cause skis to operate in coordinated fashion and, in particular, to a system having a linkage for interconnecting three skis.

Snow conditions can vary widely from place to place and even from day to day. It is more difficult and less enjoyable to ski when conditions are marginal, e.g. excessively deep "powder" or an icy crust on the snow. A typical ski is narrow and has a relatively low surface area for its length. Consequently, the ski applies a pressure greater than powdery snow can support and the ski sinks into the powder, slowing the skier. A problem with ice is that the edges of the skis provide some control on ice but the forces on the skis can exceed the breakaway force of an edge. If so, a skier can slide sideways, or worse.

This invention relates to high performance skis particularly suited to marginal conditions. By high performance it is meant skis which permit a skier to move as quickly as possible, either in terms of speed or in terms of changing direction. Adding a third ski and coupling it to the other skis will increase the surface area in contact with the snow and add an edge for control on ice. However, a problem is thus created when adding the third ski to the others; that is, the ski must be added in such a way that performance in good snow conditions is not compromised.

The known prior art relating to interconnected or coupled skis is generally concerned with sleds. As used herein, skiing refers to a system wherein the skier's feet are mounted directly (by way of boots and bindings) to the skis and the skier's feet control the skis. Sleds are typically provided with two or more skis and utilize a steering/tilting mechanism for controlling the skis.

In most sleds, a central or main ski is balanced by two outrigger skis, one on each side of the main ski. In some cases, the skis are in a side-by-side or overlapping relation and in other cases the middle ski is forward of the outrigger skis and there is no overlap between the middle ski and the outrigger skis (the heel of the middle ski is ahead of the tips of the outrigger skis). The outrigger skis are either rigidly attached to the central ski, e.g. as disclosed in U.S. Pat. No. 3,666,281 (Billings), or are connected to the central ski by a complicated mechanism for tilting at least the outrigger skis as the rider leans from side to side, e.g. as disclosed in U.S. Pat. Nos. 3,540,750 (Berger) or 3,841,649 (McMullen).

These sleds are ridden, typically in a seated position, and do not give the same sensation, or permit the same freedom of movement, as skiing. Further, the tilting/steering mechanisms on the sleds are complicated and relatively heavy, i.e. weighing more than two or three skis.

A skier traversing a slope has one ski slightly higher than the other ski, enabling the skier to remain vertical and causing the trailing (uphill) edges of the skis to dig into the snow for directional control. Sleds of the prior art emulate this condition either by rotating each ski about the longitudinal axis of the ski or by lifting one ski relative to the other.

A ski is typically rotated by means of a parallelogram mechanism, e.g. as disclosed in the Berger patent. A ski is lifted by means of a complicated mechanism, such as disclosed in the McMullen patent, which converts rotary motion to linear motion and then back to rotary motion. Either technique utilizes a mechanism which is too large, too heavy, and too complicated for skiing equipment. Of the two techniques, lifting one ski relative to the other is preferred since such permits a rider to remain vertical while traversing a slope or leaning into a turn.

A problem with either lifting or rotating a ski is that one assumes that the snow is fairly smooth. "Rough" as applied to terrain can have different meanings, depending upon the scale one uses to measure roughness. For skiing, one wants roughness on a large scale, i.e. hills or mountains. Some skiers prefer the challenge of moguls, small mounds having diameters of a couple of ski lengths or more. As used herein, rough means having bumps of a diameter less than one ski length and, particularly, of a diameter approximately equal to the distance separating the outer skis of a triple ski.

On rough terrain, sleds of the prior art can quickly transfer the combined weights of the rider and sled to just one or two skis. At best, a rough terrain can cause a bumpy ride; at worst, the rider can lose control or spill. Particularly in rough terrain, simply rotating or lifting a ski does not provide sufficient control over the position of the skis. It is desirable that the linkage between the skis have some resiliency to accommodate rough terrain. It is also desirable that triple skis respond to canting of one ski by having the middle ski assume an intermediate canted position between the canted ski and the third ski. It is also desirable to allow the outer skis to slide fore and aft relative to the middle ski. These capabilities would improve the performance of triple skis in all terrains and snow conditions but are not obtainable from tilting/steering mechanisms of the prior art.

When used in conjunction with the skis alone, "vertical" and its cognates refer to the direction perpendicular to the plane of the skis. Canting means rotating a ski in a vertical plane; e.g. lifting just the tip of one ski.

A snowboard is a single board to which both of a skier's feet are mounted in a fore and aft configuration. Edge control is obtained by leaning from side to side and a snowboard is more difficult to learn to control than a pair of skis. A problem with a snowboard is that there is only a single edge for directional control and control is best obtained in powder. Since a snowboard is often used in marginal snow conditions, it is desired to improve the directional stability of a snowboard while retaining the other characteristics of a snowboard.

In view of the foregoing, it is therefore an object of the invention to provide linked triple skis for skiing.

A further object of the invention is to provide a mechanically simple linkage for interconnecting skis into a set of three skis for skiing in deep powder.

Another object of the invention is to provide high performance Alpine skis having three edges for better performance in all snow conditions, particularly icy conditions.

A further object of the invention is to provide a linkage using only rotary motion for controlling three interconnected skis.

Another object of the invention is to provide a linkage using only rotary motion for lifting one ski relative to another in a set of three skis.

A further object of the invention is to provide a linkage for interconnecting three skis and controlling lift and cant of the skis.

Another object of the invention is to provide a linkage for interconnecting three skis for skiing in rough terrain.

A further object of the invention is to provide a resilient linkage for interconnecting three skis.

Another object of the invention is to provide a linkage for interconnecting three skis in which canting one outer ski causes the middle ski to cant an intermediate amount.

A further object of the invention is to provide linked triple skis for sledding wherein the linkage is more compact, lighter, and enables more aggressive maneuvers than sleds of the prior art.

Another object of the invention is to provide linked triple skis wherein the outer skis can be translated fore and aft relative to the center ski.

Another object of the invention is to improve the directional stability of a snowboard.

A further object of the invention is to provide bindings for a snowboard that allow the full range of motion of the triple ski configuration.

SUMMARY OF THE INVENTION

The foregoing objects are achieved in the invention in which two outer skis are coupled to a third ski located between the two outer skis. As disclosed in co-pending application 08/250,274, which is incorporated herein by reference, a trip ski system including four cranks, connected as a front pair and a rear pair. Each crank has a gear on one end and a free end. The free end of a crank is attached to a journal box on an outer ski to permit the crank to rotate freely. The gear of the crank from one outer ski meshes with the gear of a crank attached to the other outer ski, coupling the cranks in pairs and causing the cranks to rotate in opposite directions. The gears from each pair are contained in a gearbox attached to the third or middle ski. The linkage thus includes just two gear boxes, four journal boxes, and four cranks, all of which can be made very strong and light.

The outer skis include bindings for a skier. The linkage holds the three skis in a predetermined alignment, preferably approximately co-planar and parallel, and permits the skis to be moved vertically relative to each other. If one outer ski is lifted relative to the middle ski, then the front and rear cranks attached to that ski rotate, causing the gears on each crank to rotate. Since the gears from each pair of cranks are meshed, lifting one outer ski causes the other outer ski to be forced downward relative to the middle ski, which is positioned vertically between the outer skis. The cranks in the front and rear pairs need not rotate the same amount, permitting the skis to be canted in a coordinated fashion, i.e. with the middle ski in a position intermediate the outer skis. Furthermore, the journal boxes on the outer skis may be slidably mounted on the ski to allow the skier to translate the outer skis fore and aft relative to the center ski.

Also, bindings may be placed on the center ski to create a snowboard configuration. These bindings are configured to allow the skis to cant without obstruction from the boots.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
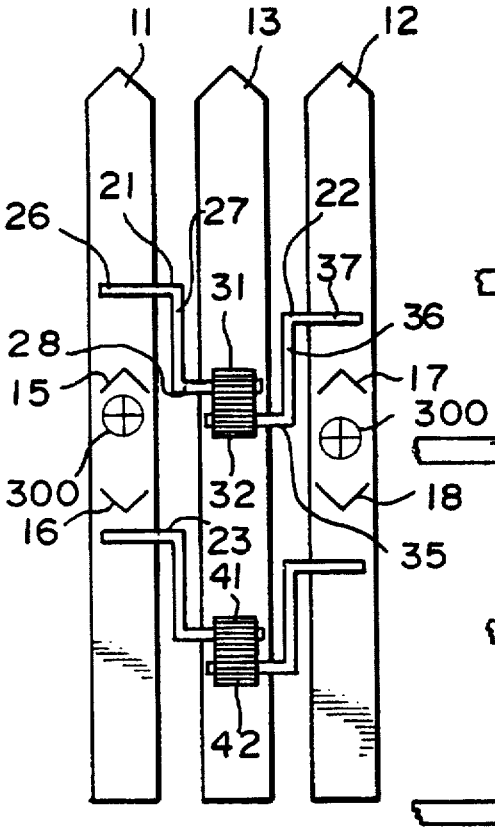
FIG. 1 schematically illustrates a linkage for a coupling three skis in accordance with a preferred embodiment of the invention.

FIG. 1 illustrates three skis interconnected by linkage constructed in accordance with the invention. Specifically, skis 11 and 12 are connected to middle ski 13 by linkage which maintains the skis, when at rest, in an approximately coplanar, parallel position and permits vertical and pivotal movement of the skis relative to each other. A skier mounts skis 11 and 12 on bindings represented by chevrons 15, 16, 17, and 18.

Cranks 21, 22, 23, and 24 interconnect skis 11 and 12 with middle ski 13, which can have a different size and shape from skis 11 and 12. Cranks 21–24 are divided into pairs in which the front pair includes cranks 21 and 22 and the rear pair includes cranks 23 and 24. Crank 21 includes free end 26 overlying ski 11 and engaging a journal box (not shown) attached to ski 11. Crank 21 includes offset 27 connecting free end 26 to shaft 28. Gear 31 is attached to shaft 28 and meshes with gear 32. Gears 31 and 32 are contained in a gear box (not shown) attached to ski 13. Gear 32 is mounted on shaft 35 which is connected by offsets 36 to free end 37. Free end 37 overlies ski 12 and engages a journal box (not shown) attached to ski 12. Cranks 23 and 24 and gears 41 and 42 are similarly attached to skis 11–13.

Figure 2:
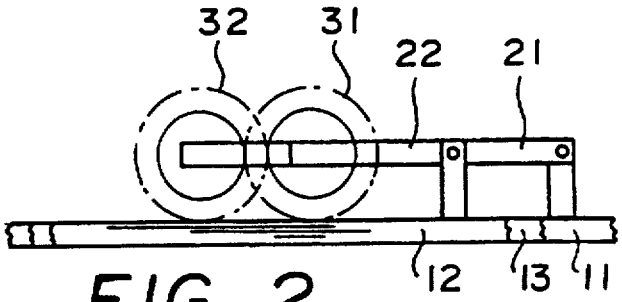
FIG. 2 illustrates the position of one pair of cranks when the skis are co-planar.
Figure 3:
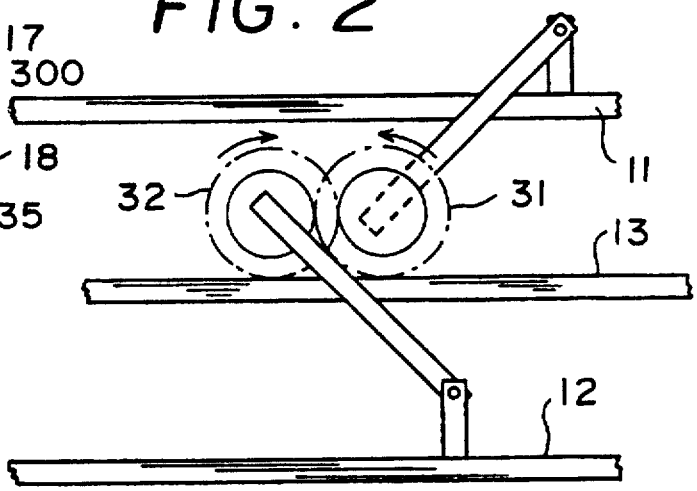
FIG. 3 illustrates the position of the skis when the cranks are rotated 45°.

In a preferred embodiment of the invention, free end 26 is orthogonal to offset 27, offset 27 is orthogonal to shaft 28, and shaft 28 is parallel to free end 26. Cranks 22–24 are similarly constructed. As such, skis 11–13 are held parallel with each other and separated by a predetermined distance. If ski 11 is raised vertically, gear 31 rotates downwardly, causing gear 32 to rotate upwardly, as illustrated in FIGS. 2 and 3. As gear 32 rotates upwardly, crank 22 moves ski 12 vertically downward.

As illustrated in FIG. 1, cranks 21–24 include right angles between the different portions thereof. If angles other than right angles are used, the skis can become splayed or stemmed as they move vertically. Gears 31, 32, 41, and 42 are preferably spur gears mounted on parallel axes. If the cranks include an angle other than a right angle, then the axes of the shafts intersect and bevel gears may be necessary for the gears to mesh properly. The embodiment illustrated in FIG. 1 is preferred for its low cost and simplicity.

Furthermore, the skis may be arranged so that the attach points on each ski are equidistant from the manufacturer defined-centerpoint of the skis 300. This allows the forces on each of the skis to be equalized. A consequence of this arrangement is that the skis, when coplanar may not be perfectly aligned as can be seen in FIG. 1.

As skis 11 and 12 move vertically relative to ski 13, the rotation of the cranks causes ski 13 to move slightly ahead of skis 11 and 12. The relative position of skis 11 and 12 does not ordinarily change. Because of the forward or rearward motion by ski 13, the skier feels only a vertical or linear motion in skis 11 and 12, even though the motion of the cranks is rotary. This is an important advantage of the invention because the feel transmitted to the skier is familiar and natural.

Figure 4:
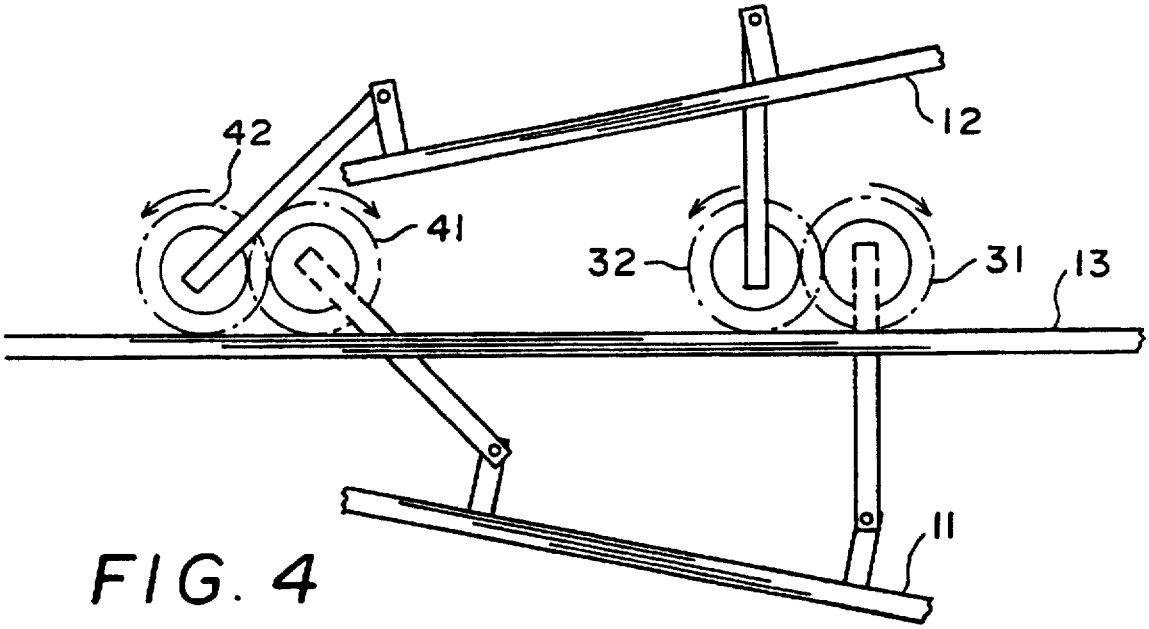
FIG. 4 illustrates canting the skis.

The relative motion of the skis is illustrated in FIGS. 2–4. FIG. 2 illustrates the initial condition of the skis. In this initial condition, skis 11–13 are co-planar, as are cranks 21 and 22. The cranks can be rotated slightly such that, as an initial condition, skis 11 and 12 are slightly above or below ski 13. A non-co-planar configuration is particularly useful for resilient cranks, described herein. In conjunction with FIGS. 2–4, it is assumed that the cranks are rigid. Whether or not the skis are co-planar, the offsets of the cranks extend in approximately the same direction.

FIG. 3 illustrates the motion of the skis when ski 11 is lifted vertically relative to middle ski 13. When ski 11 is lifted, gear 31 rotates counterclockwise. Gear 32 therefore rotates clockwise, lowering ski 12 relative to ski 13. Only one set of gears is shown in FIG. 3 because the longitudinal axes of the skis remain parallel. It is an advantage of the invention that the longitudinal axes of skis 11–13 need not be parallel as the skis are moved vertically.

In FIG. 4, ski 11 is canted downwardly with respect to ski 13 and ski 12 is canted upwardly with respect to ski 13. Skis 11 and 12 are controlled by the feet and legs of the skier. Ski 11 is lowered, rotating gear 31 approximately 90° clockwise and rotating gear 32 approximately 90° counterclockwise from the initial position. Gear 41 is rotated clockwise approximately 45° and gear 42 is rotated counterclockwise approximately 45°. The result is that the tip of ski 12 is raised more than the heel of ski 12 and the tip of ski 11 is lowered more than the heel of ski 11. Because of the coupling by the gears, ski 11 is lowered approximately the same amount that ski 12 is raised and ski 13 is positioned approximately half-way between skis 11 and 12.

Figure 5:
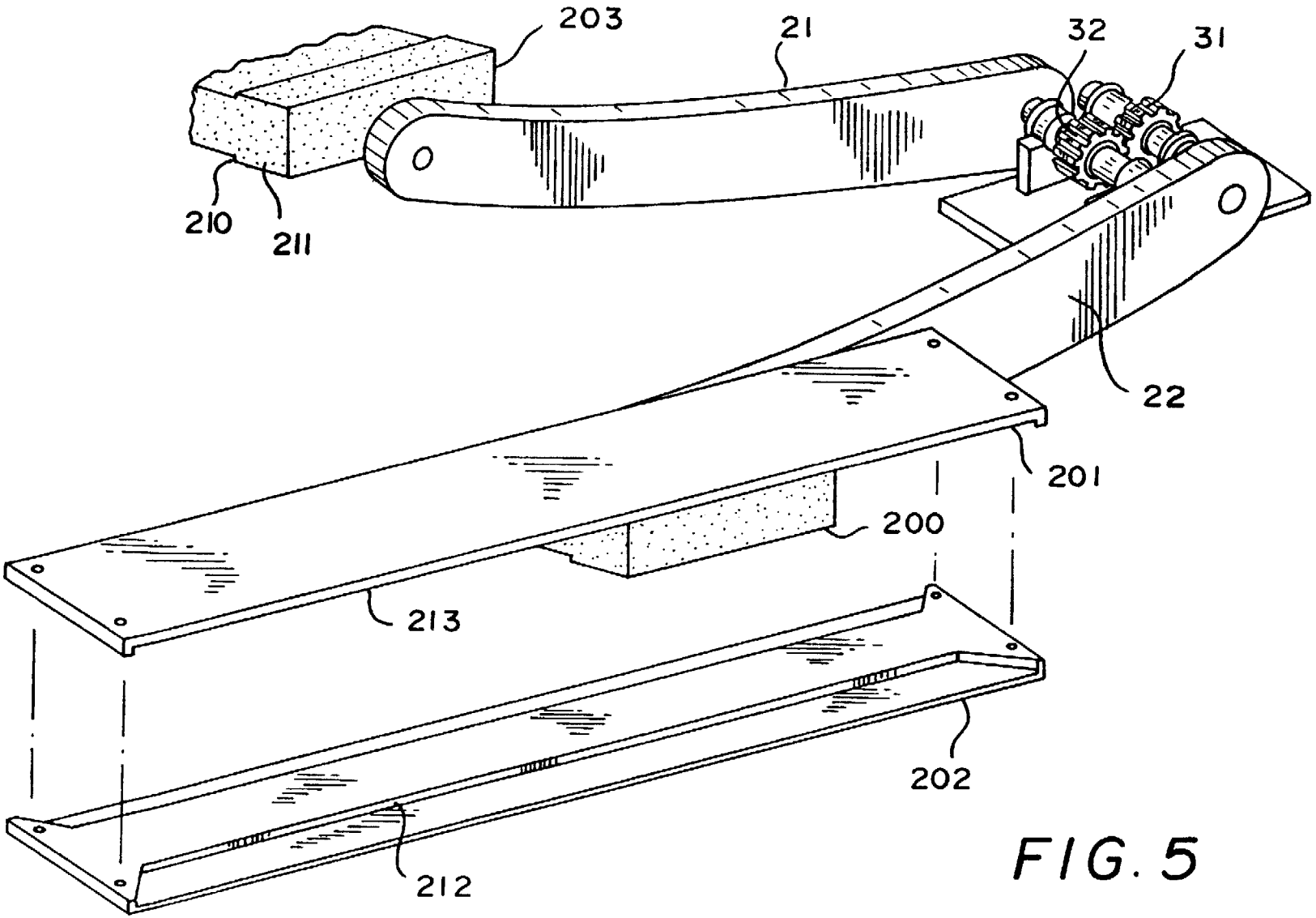
FIG. 5 illustrates the binding mechanism for providing fore and aft translation of the outer skis.

As illustrated in FIG. 5, the journal boxes on the outer skis can be mounted to allow fore and aft translation of the outer skis. Cranks 21 and 22 are pivotally connected to slide blocks 200 and 203. The slide blocks 200 and 203 are then sandwiched between slide plate 202 and binding plate 201. Both the slide plate 202 and binding plate 201 are affixed to the outer ski (not shown). The ski bindings (not shown) are then attached to binding plate 201.

The slide block 200 is formed with grooves 210 or ridges 211 or combinations thereof which interlock with complimentary ridges 212 or grooves 213 (hidden) on the binding plate 201 and slide plate 202. These grooves and ridges secure the slide block 200 between the binding plate 201 and slide plate 202, allowing the slide block 200 to slide longitudinally without dislodging laterally. Although the drawings shown one ridge 211 and one groove 210, any number or combination of ridges and grooves can be used to provide longitudinal translation. The arrangement allowing longitudinal translation is used on all of the connections between the crank arms 21, 22, 23 and 24 and the outer skis 11 and 12.

Figure 6:
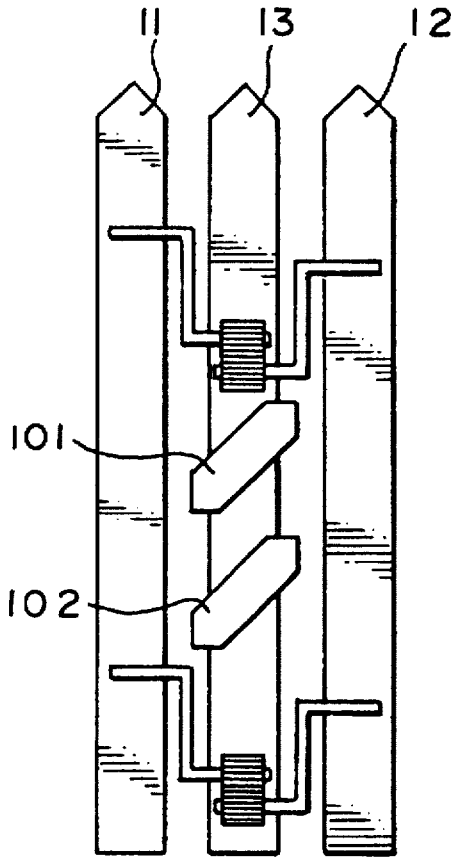
FIG. 6 illustrates three skis configured as a snowboard.
Figure 6A:
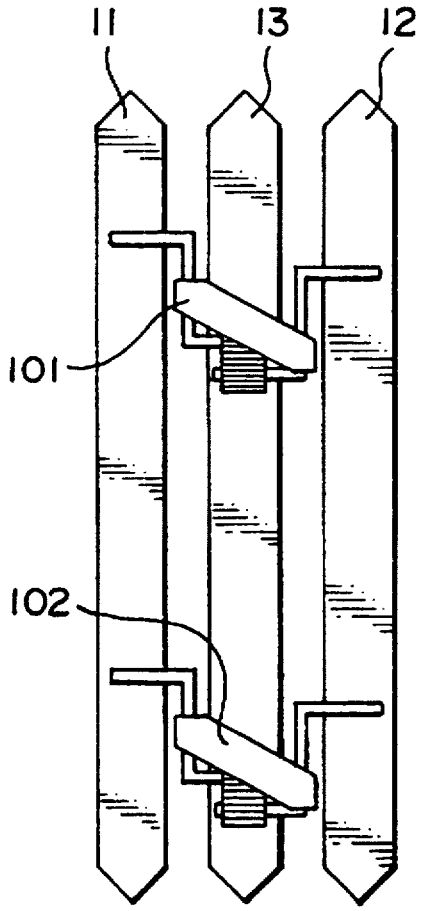
FIG. 6*a* illustrates an alternative embodiment of the snowboard configuration where the bindings are mounted proximate to the gear housings; and, FIG. 7 illustrates the mechanism for attaching the snowboard binding to the center ski.

While illustrated in a preferred embodiment with skis, the linkage of the invention can be used for other applications, e.g. snowmobiles and snowboards. FIGS. 6 and 6*a* illustrate an alternative embodiments of the invention in which bindings 101 and 102 are attached to center ski 13 to provide the characteristics of snowboarding in a system in which skis 11, 12, and 13 have a total area approximately equal to the area of a snowboard. A particular advantage of the system illustrated in FIGS. 6 and 6*a* is the three edges it provides for cutting the snow, as opposed to the single edge of a conventional snowboard. The feel of a snowboard is retained since steering is accomplished by leaning but the additional two edges provide greater directional control, particularly in crusty snow conditions.

The gear boxes and journal boxes are preferably made from thermoplastic. The cranks are preferably made from steel bar and suitably splined or flatted to engage the gears. The gears can be steel, plastic, or brass, e.g. depending on the width of the gear (if a plastic gear has a width of an inch or so, the strain on the teeth of the gear is not excessive). The slide blocks, slide plates and binding plates can be made of metal or thermoplastic. The choice of materials is a matter of design for those of skill in the manufacture of ski equipment. C-clips or other mechanisms for holding the free ends in the journals, bearings, seals, lubricants, and other construction details are also a matter of design. The skis are preferably of the same width and the cranks are preferably the same size, although the offsets of the rear cranks can be slightly longer than the offsets of the front cranks. While the overall length of the offsets depends upon skill and terrain, a length equal to the width of a ski is a good starting point.

Although gears are disclosed as the preferred method of coordinating the rotary crank movement, any means of producing the coordinated movement, such as frictional engagement, chains or other coupling means are considered without scope of the invention.

The invention thus provides triple skis for skiing in which a mechanically simple linkage interconnects three skis and uses only rotary motion for controlling the skis. The linkage uses few components, does not greatly increase the weight of the skis, and does not degrade performance in good snow conditions. The skis can be lifted or canted for aggressive skiing in all snow conditions. The middle ski adds surface area and a third edge for skiing in marginal snow conditions and can be resiliently connected to the outer skis for skiing on rough terrain.

The invention can be used to improve the performance of sleds since the simplified linkage permits a steering/tilting mechanism to be attached to only one outer ski, thereby simplifying the mechanism. A sled having a linkage constructed in accordance with the invention would be lighter and more maneuverable than a sled having prior art linkage.

Having thus described the invention, it will be apparent to those of skill in the art that various modifications can be made within the scope of the invention. For example, the shafts in each pair of cranks can be made collinear by using planetary gears in the gear boxes, though planetary gears are more expensive than the preferred spur gears. Resiliency can be obtained by using a crank of spring steel and relying on torsion of one or both shafts in each pair for resiliency. Each crank can be a single bar bent as shown or made from two or three separate pieces, e.g. separate shaft, offset, and free end. Canting can be prevented by connecting the gear boxes by chain, toothed belt, or intermediate gears. As described above, the cranks can have other than 90° bends, enabling splaying or stemming of the skis when the skis are moved vertically.

Figure 7:
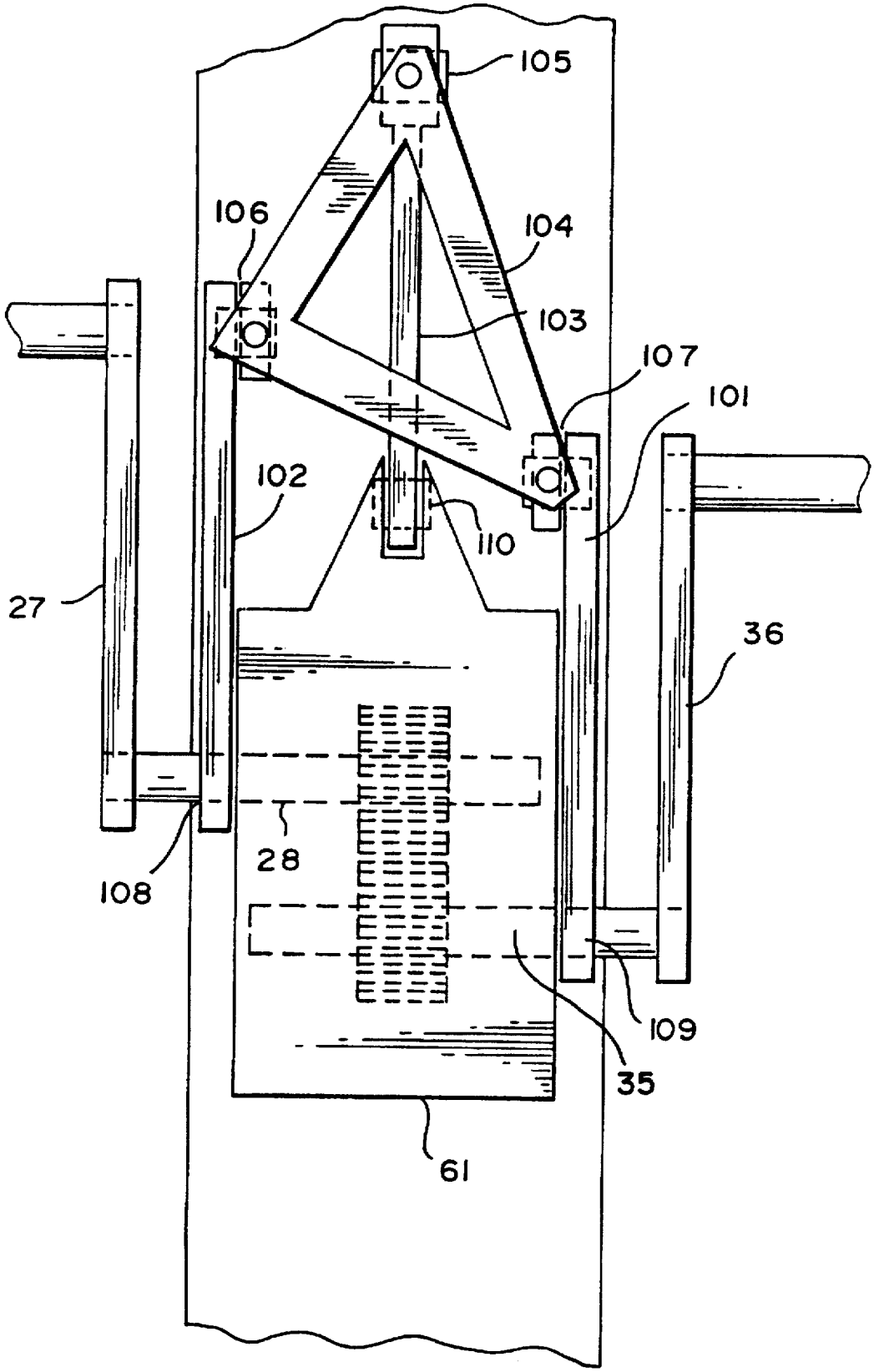

As illustrated in FIGS. 6 and 6*a*, the invention can be configured as a snowboard. The illustrated configurations place bindings 101 and 102 for left foot forward use. The bindings can be rotated counter-clockwise 90° for right foot forward if desired. It may be desirable to build up or elevate bindings 101 and 102 from the upper surface of center ski 13 to accommodate the overhang of the bindings and prevent dragging the heel or toe of a binding in the snow when cornering or to prevent interference with skis 11 and 12 if the bindings overlap adjacent skis. Alternatively a movable platform on which a binding may be supported as illustrated in FIG. 7 may be used. The binding (not shown) is attached to platform 104 which in turn is pivotally linked to binding bars 101, 102 and 103, by means of pivotal attachments 105, 106 and 107. The binding bars 101 and 102 are journaled about shafts 35 and 28 by pivotal attachments 109 and 108 respectively such that bars 101 and 102 freely rotate independent of the rotation of shafts 35 and 28. Binding bar 103 is attached to gear bar 61 by pivotal attachments 110. Linkages 101, 102 and 103 together with platform 104 form a free floating parallel bar linkage, preferably an equal length parallel bar linkage, such that platform 104 remains at all times parallel to ski 13. Thus, when the snowboard is flat on the snow, the bindings mounted to platform 104 rest as close as possible to the top of the board, providing the lowest, hence optimal, center of gravity. As the boards articulate, the Parallel bar linkage allows the movable platform carrying the bindings to be raised, providing clearance for an outer ski. The number of binding bars are a matter of design choice. Any number may be used which allow control of the snowboard while still permitting the user's boots to stay clear of the skis.

In either the ski or snowboard embodiment, design considerations may lead to the use of inner and outer skis of varying width. As such, the geometries, when the skis are articulated, especially on a canted slope, will result in the inner or outer skis losing contact with the snow surface. Consequently it may be desirable to preload the linkage in such a way as to bias the skis which would otherwise lose contact in the downward direction. For example, in the snowboard version, if the inner ski is wider than the outer skis, it may be necessary to place a biasing material, such as a foam spacer underneath the journal boxes. Similarly, in the alpine version, if the inner ski is narrower than the outer skis, a form spacer beneath the gear housing may be appropriate. The various configurations and width selections which may be made as a matter of design choice will require different placements of such preloading devices to ensure full contact of the skis with the snow surface.

What is claimed is:

1. A linkage for connecting a third ski between a first ski and a second ski and permitting vertical and longitudinal movement among the skis, wherein said linkage comprises:

a first crank and a second crank, wherein said first crank and said second crank each includes a free end;

an offset;

a shaft; and a gear attached to said shaft;

a first journal box for receiving the free end of said first crank;

means for slidably attaching said first journal box to said first ski;

a first gear box for attachment to said third ski and housing the gears attached to said first crank and said second crank, wherein said gears mesh causing said first crank and said second crank to rotate in opposite directions; and a second journal box attached to said second ski and receiving the free end of said second crank.

2. The linkage as set forth in claim 1 further comprising:

a third crank and a fourth crank, wherein said third crank and said fourth crank each includes a free end;

an offset;

a shaft; and a gear attached to said shaft;

a third journal box for receiving the free end of said third crank;

means for slidably attaching said third journal box to said first ski;

a second gear box for attachment to said third ski and housing the gears attached to said third crank and said fourth crank, wherein said gears mesh causing said third crank and said fourth crank to rotate in opposite directions; and a fourth journal box attached to said second ski and receiving the free end of said fourth crank.

3. The apparatus of claim 2 wherein said attaching means comprise:

slide blocks forming the body of said first and third journal boxes;

slide plates attached to said first ski;

binding plates attached to said slide plates whereby said slide blocks are nested between said binding plates and said slide plates thereby constraining said slide blocks to move longitudinally.

4. The apparatus of claim 2 wherein said linkage further comprises means for slidably attaching said fourth journal box to said second ski.

5. The apparatus of claim 4 wherein said attaching means comprise:

slide blocks forming the body of said journal boxes;

slide plates attached to said first and second skis;

binding plates attached to said slide plates whereby said slide blocks are nested between said binding plates and said slide plates thereby constraining said slide blocks to move longitudinally.

6. The apparatus of claim 1 wherein said attaching means comprise:

a slide block forming the body of said first journal box;

a slide plate attached to said first ski;

a binding plate attached to said slide plate whereby said slide block is nested between said binding plate and said slide plate thereby constraining said slide block to move longitudinally.

7. The apparatus of claim 1 wherein said linkage further comprises means for slidably attaching said second journal box to said second ski.

8. The apparatus of claim 7 wherein said attaching means comprise:

slide blocks forming the body of said journal boxes;

slide plates attached to said first and second skis;

binding plates attached to said slide plates whereby said slide blocks are nested between said binding plates and said slide plates thereby constraining said slide blocks to move longitudinally.

9. A ski set including a first ski, a second ski, and a third ski connected between said first ski and said second ski by a linkage permitting vertical and longitudinal relative movement among the skis, wherein said linkage comprises:

four cranks connected in pairs to said skis as a front pair and a rear pair, wherein each crank includes a gear on a first end and a free end; and wherein the gears from each pair mesh and are attached to said third ski and the free ends of each pair of cranks are slidably attached one each to the first ski and the second ski.

10. Ski apparatus including a first ski, a second ski, and a third ski connected between said first ski and said second ski by linkage permitting vertical and longitudinal relative movement among the skis, wherein said linkage comprises:

a first crank and a second crank, wherein said first crank and said second crank each includes a free end;

an offset;

a shaft; and a gear attached to said shaft;

a first journal box for receiving the free end of said first crank;

means for slidably attaching said first ski and said first journal box;

a first gear box attached to said third ski and housing the gears attached to said first crank and said second crank, wherein said gears mesh causing said first crank and said second crank to rotate in opposite directions; and a second journal box attached to said second ski and receiving the free end of said second crank.

11. Apparatus of claim 10 wherein said linkage further comprises means for slidably attaching said second journal box to said second ski.

12. Apparatus for connecting a third ski between a first ski and a second ski and permitting vertical relative movement among the skis and for mounting a binding on said third ski comprising a ski linkage and a ski binding linkage, said ski linkage comprising:

a first crank and a second crank, wherein said first crank and said second crank each includes
a free end;
an offset;
a shaft; and
a gear attached to said shaft;

a first journal box for attachment to said first ski and receiving the free end of said first crank;

a first gear box for attachment to said third ski and housing the gears attached to said first crank and said second crank, wherein said gears mesh causing said first crank and said second crank to rotate in opposite directions;

a second journal box for attachment to said second ski and receiving the free end of said second crank; and said ski binding linkage comprising means for mounting said ski binding on said third ski to permit vertical relative motion between said binding and said third ski.

13. The apparatus of claim 12 wherein said means for mounting said binding comprises:

a latch for securing the user's foot;

a binding platform attached to said latch;

a plurality of support struts pivotally attached to said binding platform, said struts also being pivotally attached to said third ski thereby allowing the binding platform to move vertically with respect to said third ski.

14. The linkage as set forth in claim 12, said ski linkage further comprising:

a third crank and a fourth crank, wherein said third crank and said fourth crank each includes
a free end;
an offset;
a shaft; and
a gear attached to said shaft;

a third journal box for attachment to said first ski and receiving the free end of said third crank;

a second gear box for attachment to said third ski and housing the gears attached to said third crank and said fourth crank, wherein said gears mesh causing said third crank and said fourth crank to rotate in opposite directions; and a fourth journal box for attachment to said second ski and receiving the free end of said fourth crank.

15. The apparatus of claim 14 wherein said means for mounting said binding comprises:

a latch for securing the user's foot;

a binding platform attached to said latch;

a plurality of support struts pivotally attached to said binding platform, said struts also being pivotally attached to said third ski thereby allowing the binding platform to move vertically with respect to said third ski.

16. A ski set including a ski binding, a first ski, a second ski, and a third ski, said third ski connected between said first ski and said second ski by a linkage permitting vertical relative movement among the skis, said linkage comprising four cranks connected in pairs to said skis as a front pair and a rear pair, wherein each crank includes a gear on a first end and a free end and wherein the gears from each pair mesh and are attached to said third ski and the free ends of each pair of cranks are attached one each to the first ski and the second ski, said ski binding being connected to said third ski by a moveable mount permitting vertical relative movement between said ski binding and said third ski, said moveable mount comprising a plurality of links each having a first end and a second end, wherein each link is operatively attached at said first end to said ski binding and operatively attached at said second end to said third ski.

* * * * *